US006370348B1

(12) United States Patent
Okano et al.

(10) Patent No.: US 6,370,348 B1
(45) Date of Patent: Apr. 9, 2002

(54) DEVELOPING APPARATUS INCLUDING INTERMITTENT DEVELOPER AGITATING FEATURE, AND IMAGE FORMING APPARATUS USING SAME

(75) Inventors: Keiji Okano, Toride; Koichi Suwa, Kawasaki; Masahiro Yoshida, Kashiwa; Hideki Matsumoto, Mishima, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/570,060

(22) Filed: May 12, 2000

(30) Foreign Application Priority Data

May 20, 1999 (JP) ..... 11-139848
Apr. 17, 2000 (JP) ..... 2000-115441

(51) Int. Cl.[7] ..... G03G 15/08
(52) U.S. Cl. ..... 399/256; 399/263
(58) Field of Search ..... 399/254, 256, 399/258, 263

(56) References Cited

U.S. PATENT DOCUMENTS

| | | | | |
|---|---|---|---|---|
| 5,012,285 A | | 4/1991 | Oka et al. | 355/245 |
| 5,202,728 A | * | 4/1993 | Maeshima et al. | 399/274 X |
| 5,287,151 A | * | 2/1994 | Sugiyama | 399/258 |
| 5,618,647 A | | 4/1997 | Kukimoto et al. | 430/106.6 |
| 6,058,284 A | | 5/2000 | Okano et al. | 399/284 |
| 6,115,575 A | * | 9/2000 | Kinoshita et al. | 399/286 |

FOREIGN PATENT DOCUMENTS

| | | |
|---|---|---|
| JP | 57-120965 | 7/1982 |
| JP | 1-052182 | 2/1989 |
| JP | 3-230183 | 10/1991 |
| JP | 3-287280 | 12/1991 |
| JP | 4-110876 | 4/1992 |
| JP | 10-39595 | 2/1998 |
| JP | 11-119550 | 4/1999 |

* cited by examiner

*Primary Examiner*—Fred L Braun
(74) *Attorney, Agent, or Firm*—Fitzpatrick, Cella, Harper & Scinto

(57) ABSTRACT

A developing apparatus includes a developer containing portion containing a developer having a weight average particle diameter of not more than 7 $\mu$m, a developer bearing member for bearing a developer, and an agitating member that agitates the developer contained in the developer containing portion. The agitating member is intermittently driven with respect to rotation of a developing sleeve. The agitating member is driven to rotate for one page every time the image forming apparatus performs a predetermined number of printing operations. A rod member having a crank-like shape may be used as the agitating member and both of the end portions serve as the center of rotation. By controlling the drive of the agitating member, it is possible to effectively adjust the supply of toner to the developing sleeve and prevent the density lowering phenomena caused due to inflow of a large amount of the new toner presented at the rear of the developing container. The agitating member may be positioned closest to the developing sleeve and may be arranged below the toner container. Accordingly, to these arrangements, the image density after printing a low print pattern can be prevented from being lessened to obtain a uniform image density even though a one-component magnetic developer having the weight average particle sized diameter of not more than 7 $\mu$m is used.

39 Claims, 8 Drawing Sheets

DEVELOPING APPARATUS INCLUDING INTERMITTENT DEVELOPER AGITATING FEATURE, AND IMAGE FORMING APPARATUS USING SAME

BACKGROUND OF THE INVENTION

1. Field of the Invention

The present invention relates to a developing apparatus for use in image formation adopting an electrophotographic process and an image forming apparatus provided with this developing apparatus.

2. Related Background Art

As shown in FIG. 10, as an example of such a developing apparatus, a developing apparatus adopting one-component toner (referred to as toner hereunder) which is a developer has been known and come into practical use.

Such a developing apparatus is provided with a developing sleeve 3 which is a non-magnetic developer bearing member formed of a pipe made of aluminum or stainless steel, and a magnet 4 having a plurality of magnetic poles N and S alternately formed in the peripheral direction thereof is fixedly arranged inside the developing sleeve 3.

The surface of the developing sleeve is processed so as to have an appropriate surface roughness so that desired amount of toner can be born and carried.

An elastic blade 8 formed of, for example, urethane rubber or silicon rubber is fixed as a developer regulating member to a supporting sheet metal (not shown) on the developing sleeve 3 and abuts on the peripheral surface of the developing sleeve 3 by a predetermined pressure.

In such a developing apparatus, toner 7 attracted on the developing sleeve 3 by the magnetic force of the magnet 4 is carried on the developing sleeve 3 to be frictionally charged; an appropriate amount of the toner 7 is slid between the developing sleeve 3 and the elastic blade 8 to be frictionally charged while being regulated by the elastic blade 8; and the toner 7 having an appropriate electric charge given thereto is then carried to a developing area in the vicinity of a portion in which the developing sleeve 3 is opposed to a photosensitive drum 1 as a latent image bearing member so that the toner 7 is subjected to development.

On the other hand, the toner which has not been subjected to development moves to the upper portion of the elastic blade 8 as the developing sleeve 3 rotates and returns again into a toner container 6 which is a developer container so that it is circulated in a direction indicated by arrows in FIG. 10.

An agitating member 10 as agitating means is a rod member having a crank-like shape, and the both ends thereof serve as a center of rotation so that the agitating member is rotated in a direction shown in FIG. 10.

Incidentally, it is common, for example, to reduce the rotational driving force from a driving source for the developing sleeve 3 to an appropriate rotational speed by using a gear train so that the agitating member 10 is driven to be rotated and utilized.

In such a developing apparatus adopting the magnetic one-component toner, it is known that the toner having a relatively smaller particle diameter in the toner contained in the toner container is consumed by priority.

As disclosed in, for example, Japanese patent application laid-open No. 1-52182, there is proposed formation of a partition in the toner container as a countermeasure so that a small chamber on the developing sleeve side and a replenishing chamber for replenishing the toner to the small chamber are formed.

This can cause the toner having a smaller particle diameter to be consumed by priority in the initial stage and increase the average particle diameter of the toner in the small chamber, but the toner in the small chamber is balanced with the toner in the replenishing chamber to achieve stable transition when the particle diameter of the toner in the small chamber reaches a predetermined level, thereby preventing the particle diameter of the toner in the replenishing chamber from being increased after an endurance.

However, when providing a partition in the developing apparatus adopting the magnetic one-component toner, the toner circulation in the vicinity of the developing sleeve 3 is enlarged as shown in FIG. 11, which reduces the advantage of the partition 20.

That is because the large circulation of the toner 7 in the toner container 6 at the rear of the developing sleeve 3 causes the toner flow and the new toner to flow toward the developing sleeve 3 and counterchanging of these types of toner becomes prominent to provoke inflow of the toner from the upper portion of the partition 20.

Therefore, installation of the partition 20 is difficult in such a developing apparatus.

Further, in the above-described developing apparatus, recent reduction in the particle diameter of the toner aiming to increase high-quality image the reproducibility per dot leads to such a tendency as that the image density is lowered. FIG. 12 is a graph showing an initial image density transition caused due to a difference in central particle diameter of the toner in the above-mentioned developing apparatus.

As shown in FIG. 12, although the initial image density tends to be lowered (which will be referred to as the initial density lowering hereinafter) with respect to any particle diameter in such a developing apparatus, this tendency becomes remarkable if the central particle diameter is smaller.

The initial density low level is not very prominent when the central particle diameter is not less than 8 $\mu$m, but it can be considered that this level should be improved when the central diameter is less than 8 $\mu$m or more specifically not more than 7 $\mu$m.

According to examination of the present inventors, as a cause of the initial density lowering, it has been revealed that the toner having a relatively small particle diameter in the toner contained in the developing apparatus tends to be concentrated on the developing sleeve at the stage of bringing the toner into use and the triboelectricity distribution of the toner coated on the developing sleeve becomes thereby broad (a ratio of the toner having the optimum triboelectricity for development is reduced), thus reducing the developing ability. Since existence of the toner having a small particle diameter becomes a problem, this phenomenon remarkably occurs as the central particle diameter of the toner becomes smaller.

Furthermore, is has been also discovered that such a phenomenon becomes prominent as images of patterns with a small consumption of the toner are continuously formed (for example, the solid black becomes further thin immediately after the solid white images are continuously formed).

That is because an amount of the toner fine powder coated on the developing sleeve is increased as the toner consumption is smaller.

Therefore, there may be unstableness such that a line width, the density and others of the printed image may vary depending on patterns of images to be formed in the above-described developing apparatus.

As means for preventing such unstableness, uniformization of the toner particle diameter (cutting the particle diameter on the fine power side during manufacture) can be considered, but this deteriorates a yield ratio during the toner manufacture to increase the cost, which is not a realistic means for preventing unstableness.

SUMMARY OF THE INVENTION

It is an object of the present invention to provide a developing apparatus capable of performing stable development by using a developer having a weight average particle diameter is not more than 7 μm and an image forming apparatus having this developing apparatus.

It is another object of the present invention to provide a developing apparatus which can prevent an image density from being lowered and constantly obtain an image density irrespective of a pattern of an image to be formed even though a developer having a weight average particle diameter of not more than 7 μm is adopted or provide an image forming apparatus having such a developing apparatus.

It is still another object of the present invention to provide a developing apparatus comprising: a developer containing portion for containing therein a developer having a weight average particle diameter of not more than 7 μm; a developer bearing member for bearing a developer; and an agitating member for agitating the developer contained in the developer containing portion, wherein the agitating member intermittently moves.

It is yet another object of the present invention to provide an image forming apparatus comprising: an image bearing member for bearing a latent image; and a developing apparatus for developing the latent image, the developing apparatus including: a developer containing portion for containing therein a developer having a weight average particle diameter of not more than 7 μm; a developer bearing member for bearing a developer; and an agitating member for agitating the developer contained in the developer containing portion, wherein the agitating member intermittently moves.

Other objects and advantages of the present invention will become clear by the following detailed description read in conjunction with the accompanying drawings.

DETAILED DESCRIPTION OF THE DRAWINGS

Figure 5A:
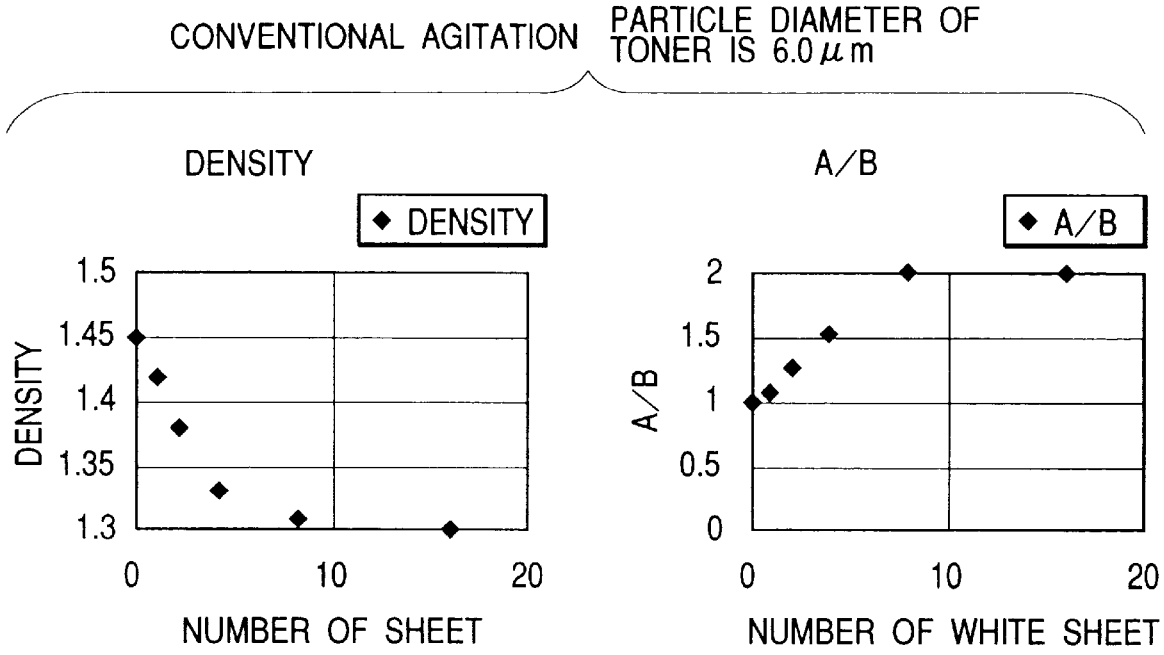
Figure 5B:
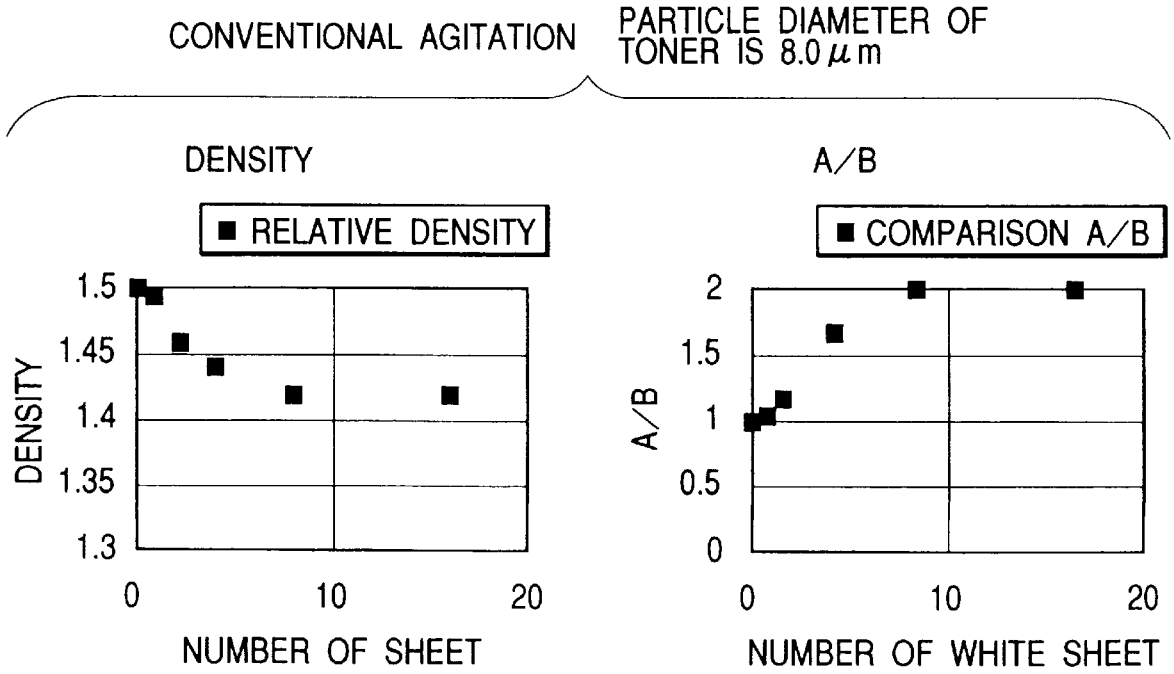
Figure 5C:
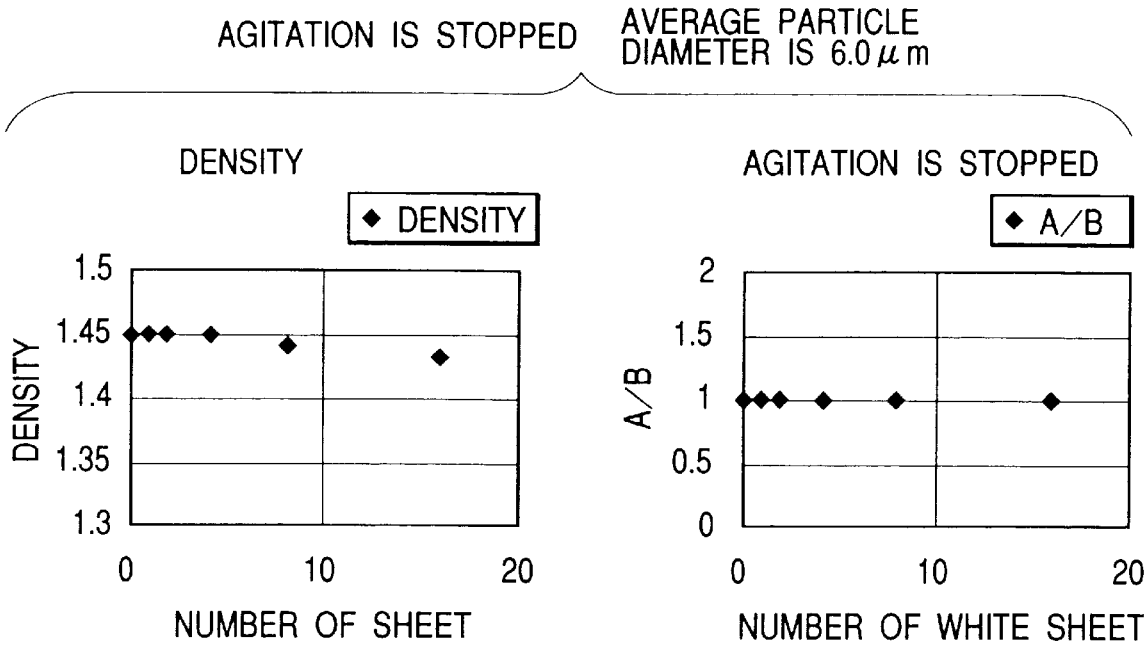
Figure 6:
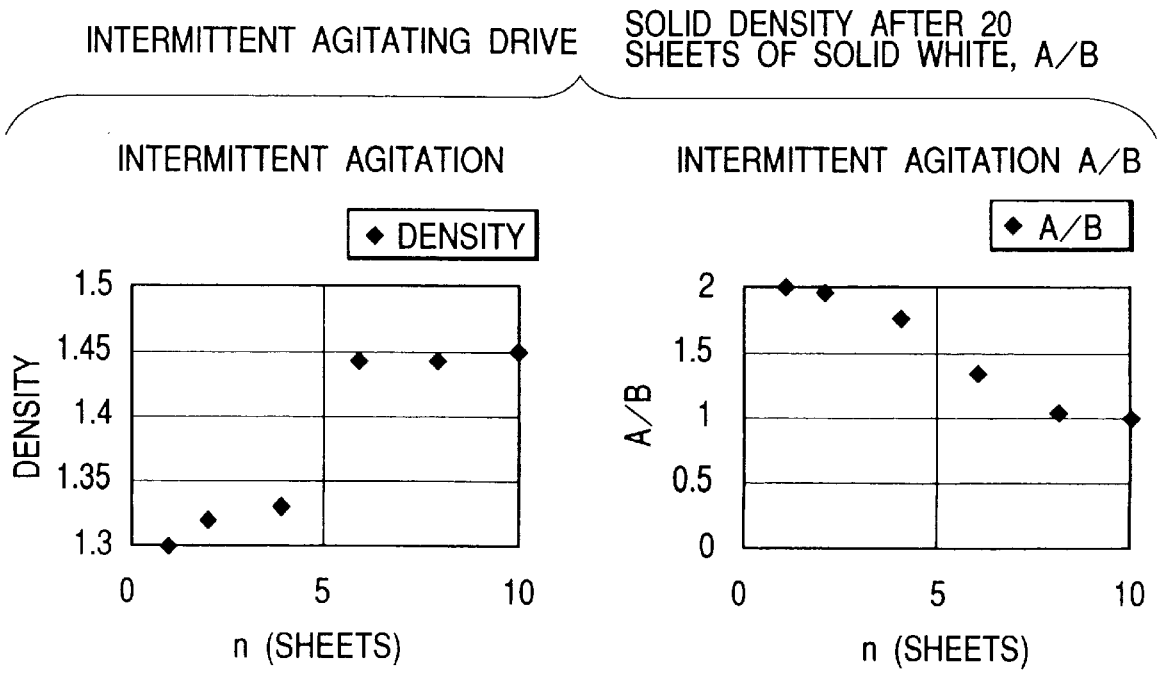
Figure 7:
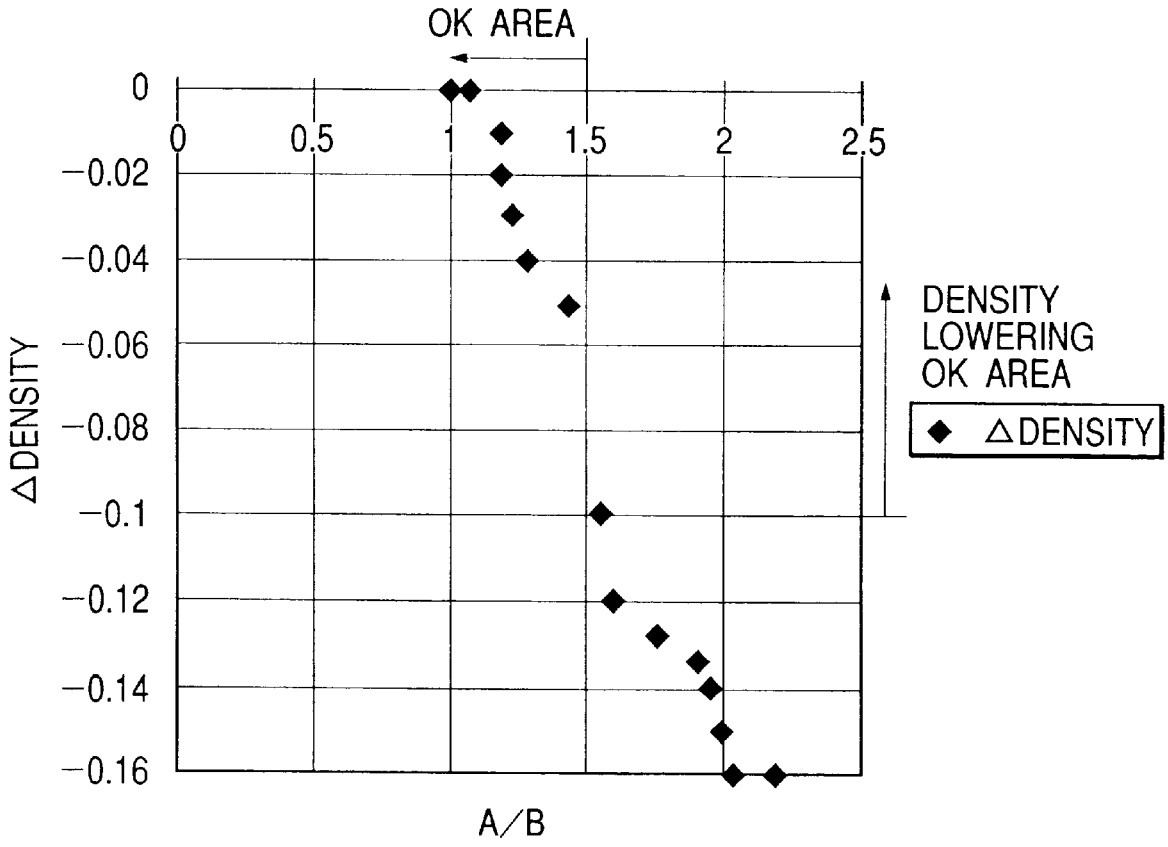
Figure 8:
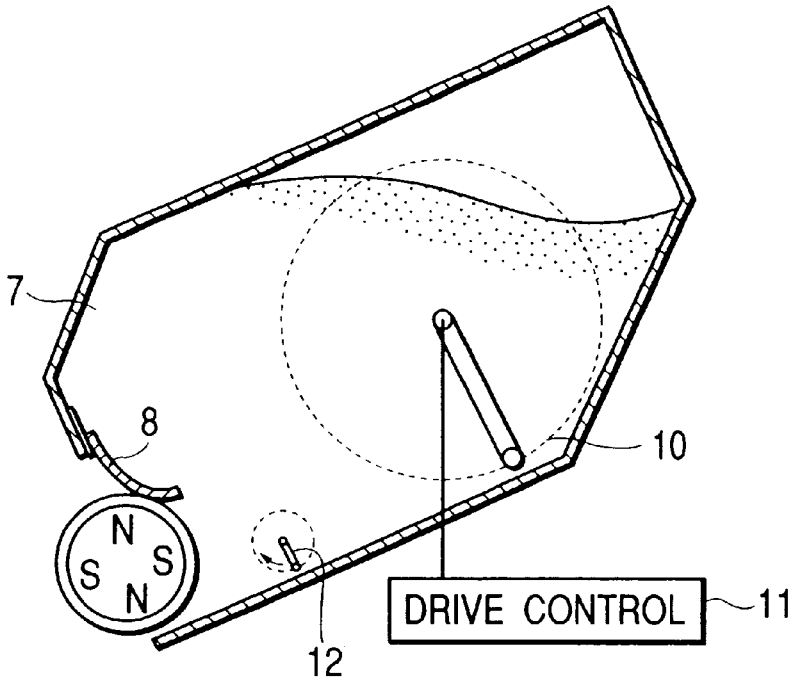
Figure 9:
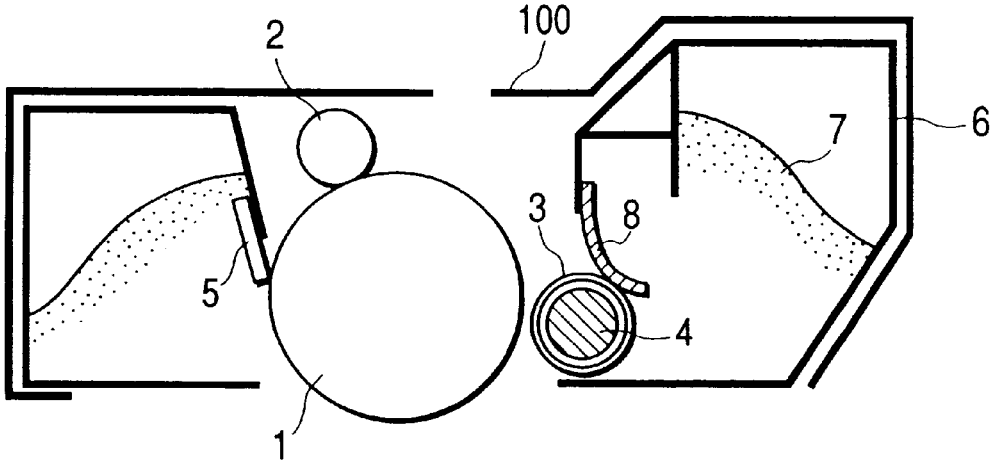
Figure 10:
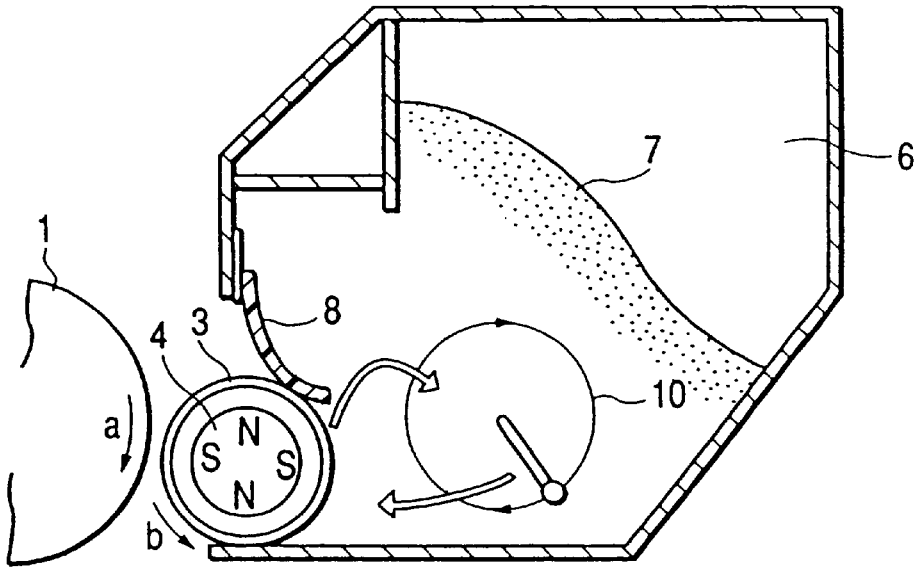
FIG. 10 PRIOR ART
Figure 11:
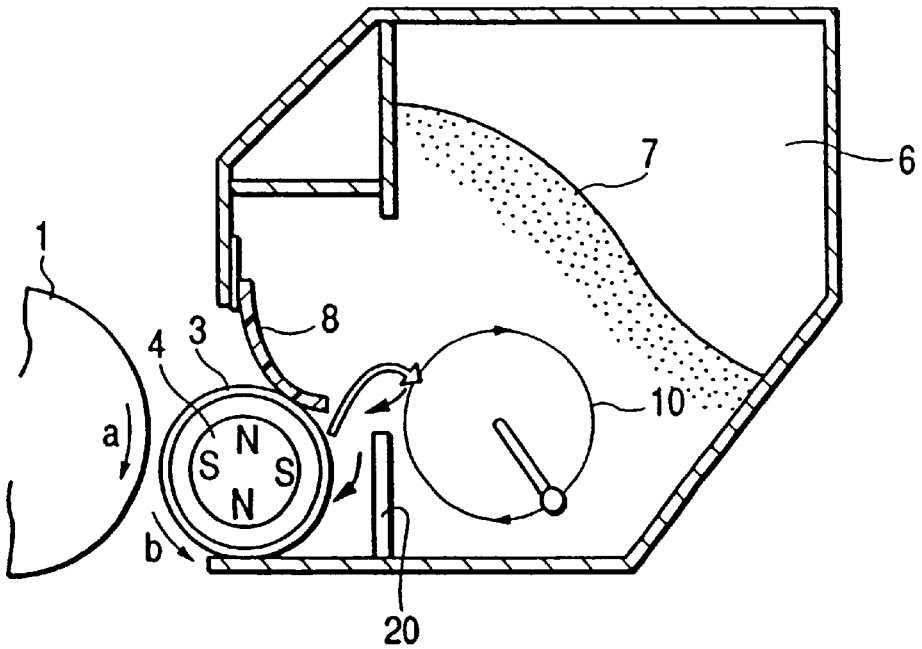
FIG. 11 PRIOR ART
Figure 12:
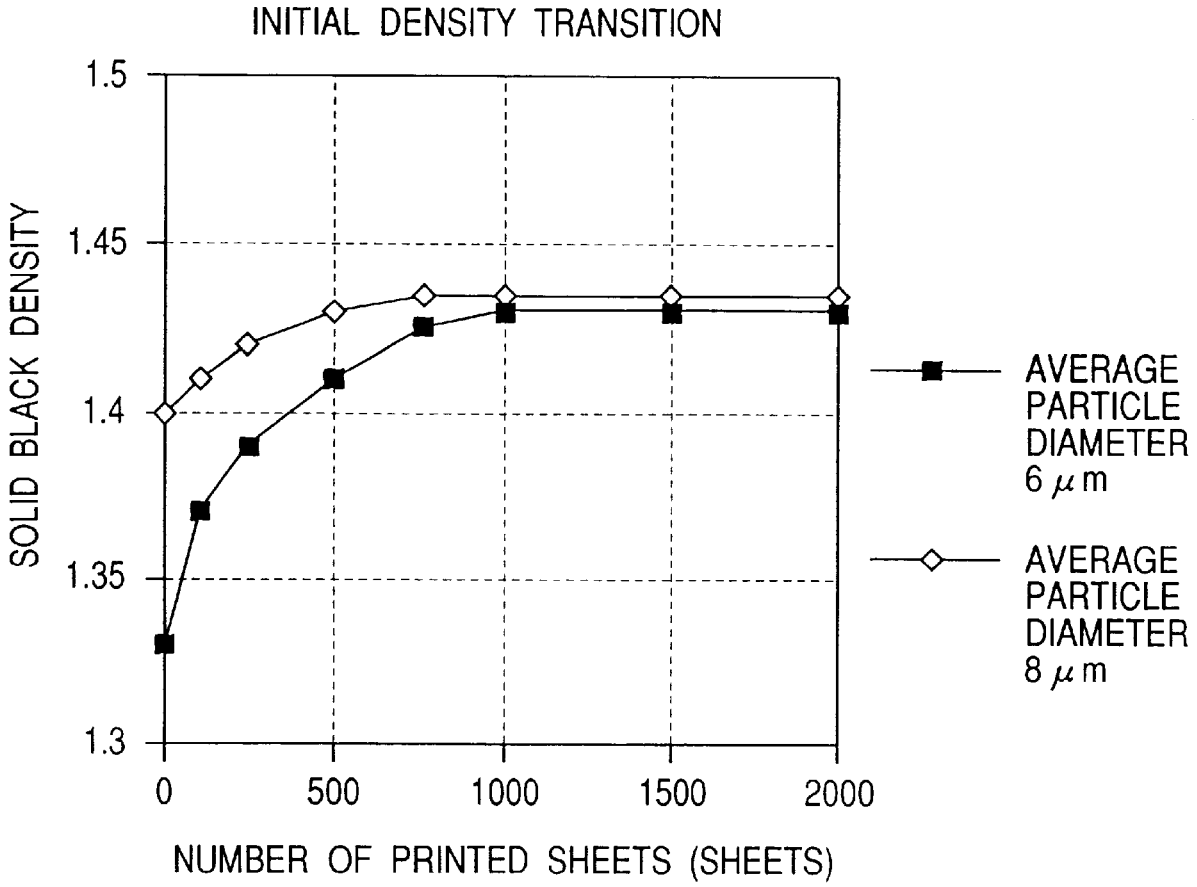
Figure 13:
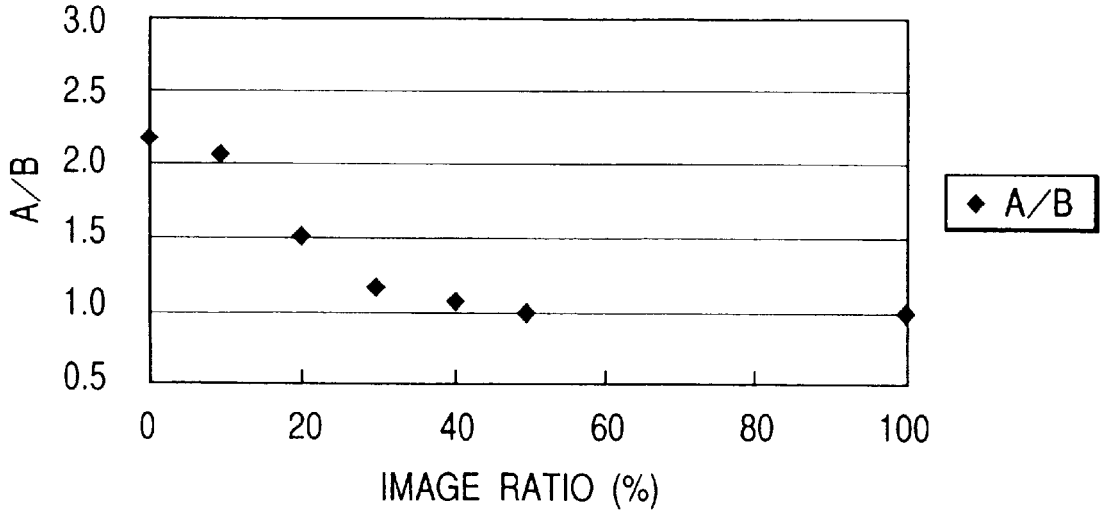

FIG. 5A is a graph showing the relationship between an amount of fine powder of a developer on a developer bearing member and an initial density of an image in a prior art image forming apparatus adopting a developer having a weight average particle diameter of 6 μm, FIG. 5B is a graph showing the relationship between the amount of fine powder and the initial density in the prior art image forming apparatus adopting a developer having a weight average particle diameter of 8 μm, and FIG. 5C is a graph showing the relationship between the amount of the fine powder and the initial density of an image in cases where agitation by the agitating means is stopped;

FIG. 6 is a graph showing the relationship between the amount of fine powder of the developer on the developer bearing member and the initial density of an image in cases where the agitating means is intermittently driven to rotate;

FIG. 7 is a graph showing the relationship between the amount of fine powder of the developer on the developer bearing member and a density Δ;

FIG. 8 is a cross-sectional view showing a developing apparatus according to a second embodiment of the present invention;

FIG. 9 is a cross-sectional view showing a process cartridge according to a third embodiment of the present invention;

FIG. 10 is a cross-sectional view showing a prior art developing apparatus;

FIG. 11 is a cross-sectional view showing a prior art developing apparatus;

FIG. 12 is a graph showing the relationship between a toner particle diameter and an initial image density transition of an image; and FIG. 13 is a graph showing A/B after printing with a varied image ratio.

DESCRIPTION OF THE PREFERRED EMBODIMENTS

Preferred embodiments according to the present invention will now be described with reference to the accompanying drawings.

First Embodiment

Figure 1:
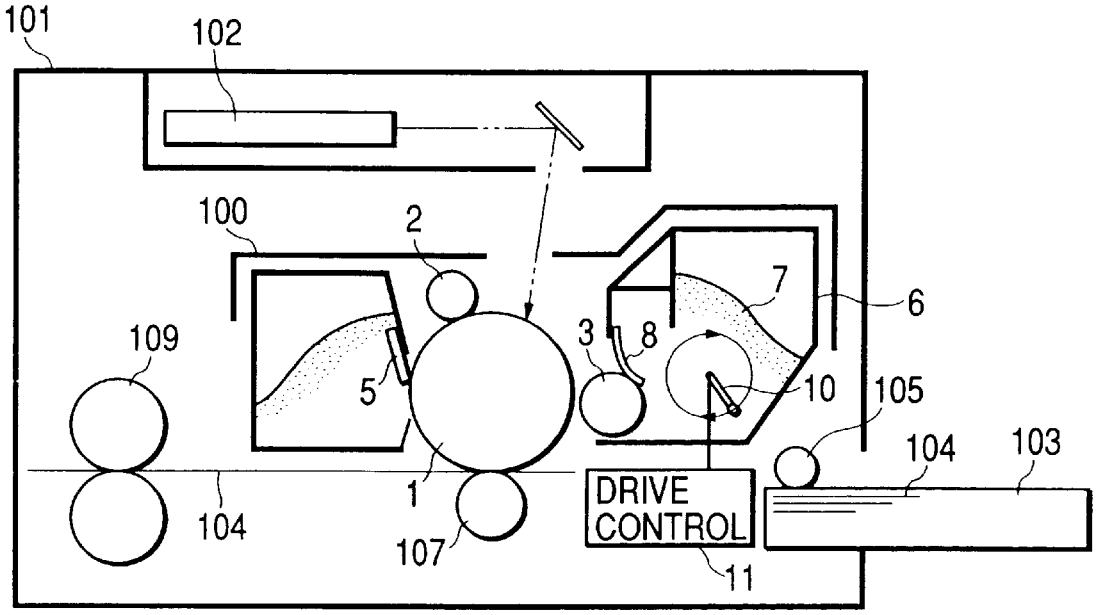
FIG. 1 is a cross-sectional view showing an image forming apparatus according to a first embodiment of the present invention.

FIG. 1 is a view showing an example of an image forming apparatus according to a first embodiment of the present invention.

In FIG. 1, reference numeral 101 denotes an image forming apparatus main body.

In such an image forming apparatus, as shown in FIG. 1, the surface of a photosensitive drum 1 as a cylindrical latent image bearing member, which rotates in one direction, is uniformly charged by a charging apparatus 2, and a latent image is then formed on that surface by an exposing apparatus 102.

The latent image formed on the photosensitive drum 1 is visualized as a developer image by supplying a developer 7 on the photosensitive drum 1 by using a developing apparatus 6.

It is to be noted that a bias power supply (not shown) obtained by superimposing an alternating-current bias to a direct-current bias is connected between the photosensitive drum 1 and a developing sleeve 3 so that an appropriate developing bias can be supplied.

Meanwhile, a transfer material 104 as a recording material is fed by a sheet feeding roller 105 to be synchronized with the developer image on the photosensitive drum 1 by a registration roller (not shown) and then supplied to a transfer apparatus 107.

In this manner, the developer image on the photosensitive drum 1 visualized by the developer 7 is transferred to the transfer material 104 by the transfer apparatus 107.

The developer image transferred on the transfer material 104 is carried together with the transfer material 104 to a fixing apparatus 109, and the fixing apparatus 109 applies heat or a pressure to the developer image so that the developer image is fixed to be a recorded image.

On the other hand, the developer remaining on the photosensitive drum 1 after a transfer process without being transferred is removed from the photosensitive drum 1 by a cleaning apparatus having a blade 5.

Figure 2:
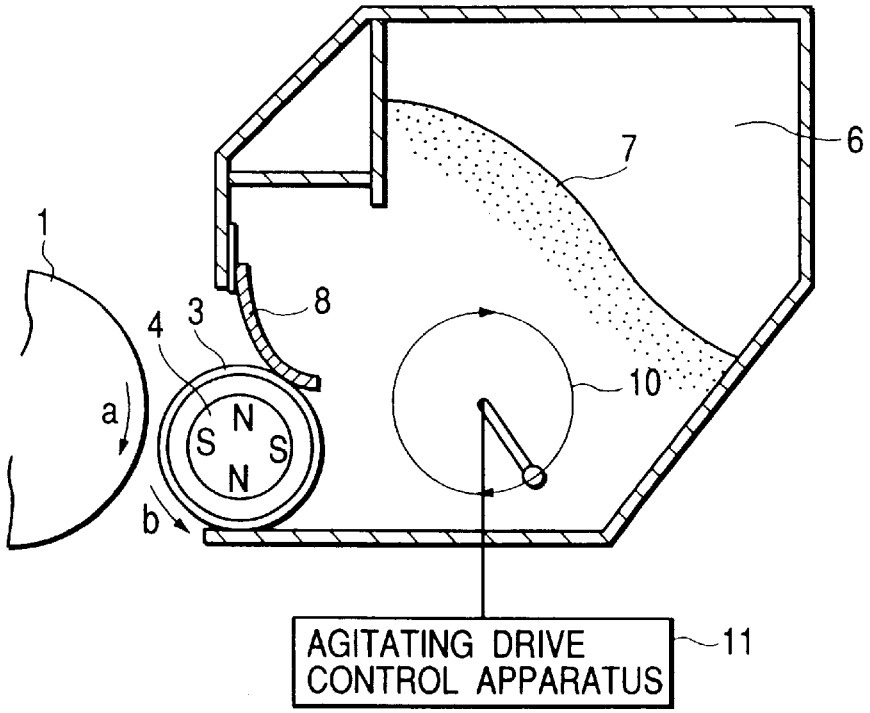
FIG. 2 is a cross-sectional view showing a developing apparatus provided in the image forming apparatus illustrated in FIG. 1.

Subsequently, the surface of the photosensitive drum 1 is again charged by the charging apparatus 2 to repeat the above-described process. FIG. 2 shows a schematic structure of the developing apparatus 6 according to this embodiment.

The developing apparatus 6 includes: a toner container as a developer container for containing therein a developer; a developing sleeve 3 as a rotatable developer bearing member which is so provided as to be opposed to the photosensitive drum 1 and bears the developer on the peripheral surface thereof; and an agitating member 10 as rotatable agitating means which has an axial line parallel to an axial direction of the developing sleeve 3 and agitates the developer in the toner container 6.

The developing sleeve 3 is a non-magnetic aluminum sleeve having diameter of 16 mm (ϕ16) and has a surface coated with a resin layer containing conductive particles.

A magnet roll 4 having four poles in the peripheral direction thereof is fixed and provided in the developing sleeve 3.

As a developer regulating member 8, silicon rubber is used so that its abutting force relative to the developing sleeve 3 becomes 30 gf/cm ($30\times10^{-3}\times9.8=0.294$ N/cm) to 40 gf/cm ($40\times10^{-3}\times9.8=0.392$ N/cm) (abutting load per 1 cm in a longitudinal direction of the developing sleeve 3).

The toner 7 is magnetic one-component toner having a negative electrostatic property.

In order to produce the toner 7, particles of a magnetic material, a negative charge controlling agent and a wax as its components are first fused and kneaded in a stainless-based copolymer as a bonding resin; the kneaded product is cooled down and then coarse-ground by a hammer mill; it is further course-ground by a jet mill; the obtained coarse-ground product is classified by using the wind force to obtain classified powder having a weight average particle diameter of 6 μm; and a hydrophobic silica fine powder material is mixed to the classified product having the average particle diameter of 6 μm using a henschel mixer, thereby obtaining the developer.

Additionally, as the toner 7, the developer having the weight average particle diameter in a range of 3.5 to 7.0 μm (mainly, approximately 6 μm) is used among the above-mentioned developer.

In regard to a developing bias applied to the developing sleeve, if a gap between the photosensitive drum 1 and the developing sleeve 3 is, for example, approximately 300 μm, an alternating-current voltage having a rectangular wave Vpp of 1600 and a frequency of 2200 Hz is superimposed on a direct-current voltage of −500 V to be applied.

The photosensitive drum 1 is charged to have a charging potential Vd=−600 V and a potential at a laser exposing portion Vl=−150 V, which results in reversal development of a Vl portion.

This embodiment is characterized in that the agitating member 10 is intermittently driven with respect to rotation of the developing sleeve 3.

In this embodiment, the control is effected in such a manner that the agitating member 10 is driven to rotate for one page every time the image forming apparatus performs seven-page printing (seven times of image formation).

Figure 3:
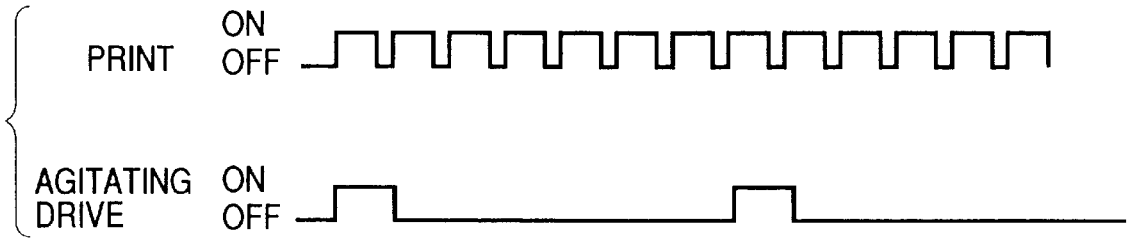
FIG. 3 is a timing chart showing an operation timing of agitating means provided in the developing apparatus illustrated in FIG. 2 with respect to an image forming operation.

FIG. 3 shows a sequence relating to the control over the rotational driving of the agitating member 10.

A rod member having a crank-like shape is used as the agitating member 10 and its both end portions serve as a center of rotation. Although a method for controlling drive of the agitating member by providing a driving source exclusively used for the agitating member is used, the present invention does not have to be restricted thereto.

According to this embodiment, controlling drive of the agitating member can effectively adjust supply of the toner to the developing sleeve and prevent the density lowering phenomenon caused due to inflow of a large amount of the new toner presented at the rear of the developer container.

The following describes a result of examination conducted by the present inventors with respect to the agitating member and the image property.

It is assumed that the developing apparatus and the image forming apparatus used in this experiment have the above-described configurations. It is to be noted that detailed experimental conditions are as follows.

Experimental Conditions

Experimental environment: a temperature of 23° C., a humidity of 60%

Process speed of the image forming apparatus: 80 mm/sec

Maximum rotational trajectory circle diameter of the agitating member (D): 30 mm Rotational speed of the agitating member: 12 rpm (12/60=0.2 1/sec)

In addition, the toner used in this experiment has the weight average particle diameter of 6.0 μm and its content of the fine powder having the weight average particle diameter of not more than 3.0 μm is 13%.

(1) Print Pattern, Number of Sheets (Number of A4-size Sheets) and Image Density At first, a number of solid white printed sheets, a solid black density and a particle size of the toner on the sleeve were first measured by using the prior art developing apparatus as a comparative example.

Method of Experiment

1. The solid black image is formed for five sheets, and the image density, the weight average particle diameter of the toner on the developing sleeve and an amount of the fine powder are measured.

It is to be noted that a Macbeth reflection densitometer (manufactured by Macbeth Co.) was used for the density measurement.

An image ratio of the print pattern was then changed and printing was carried out for 10 A4-size pages. Thereafter, the solid black density and the particle size of the toner on the sleeve were thereafter measured. FIG. 13 shows its result. There was used an image pattern such that 10% of an image ratio: a one-dot-and-nine-space horizontal line, 20% of the same: a two-dot-and-eight-space horizontal line. After printing a pattern having a low image ratio, A/B becomes large and the solid black image density is decreased. When the image ratio is not more than approximately 20%, this phenomenon becomes prominent.

It is to be noted that the image ratio means a ratio of an image area formed on each one recording material (A4 size) to an A4-size paper area.

Further, FIG. 5B shows a result of the experiment similar to the above conducted by using the toner having the average particle diameter of 8 μm. In this case, although there is such a tendency as that an amount of the fine powder on the developing sleeve is increased due to passing the paper having an image formed thereon with a low print ratio and the developing ability is thereby lowered, the reduction in density is small. Further, since the density is not less than 1.4, a sufficient quality level can be obtained.

As the solid black image density, a value of not less than 1.40 can achieve a high quality image.

Moreover, this value is determined to indicate the density and the amount of fine powder of the 0th printed sheet shown in FIGS. 5A and 5B.

2. After the solid white images are formed on n sheets, the weight average particle diameter and the amount of the fine powder of the toner on the developing sleeve are measured. The solid black image is then formed on one sheet to measure the image density.

Incidentally, as to measurement of the weight average particle diameter and the amount of the fine powder of the toner on the developing sleeve, a toner sample on the developing sleeve is collected to measure the amount of the fine powder and a Coulter multisizer (manufactured by Coulter Inc.) is used to measure the particle diameter.

Additionally, a quantity ratio of the particle diameters not more than 3.0 $\mu$m (not more than M/2 assuming that the weight average particle diameter of the original toner is M) is determined as the amount of the fine powder.

Furthermore, it is assumed that the amount of the fine powder of the toner on the developing sleeve is A (%) and the amount of the fine powder in the toner container is B (%). In this embodiment, A=13% is attained.

Results

FIG. 5A shows the results obtained when using the toner weight average particle diameter of 6.0 $\mu$m is used.

As shown in FIG. 5A, when the solid black image is formed, the fine powder on the developing sleeve is consumed and reduced, and the image density is thereby sufficiently increased. However, passing the paper having the solid white image (low print) formed thereon causes the fine powder A/B on the developing sleeve to be increased, which reduces both the developing ability and the image density.

In the prior art general developing apparatus, A/B is set to approximately 2.0.

Further, it has been found that reduction in the average particle diameter of the toner takes a significant effect.

(2) Stop of Agitation

FIG. 5C shows a result obtained by stopping agitation caused by driving the agitating member to conduct the measurement as similar to the above.

As shown in FIG. 5C, it has been revealed that stopping agitation rarely increases the quantity of the fine powder of the toner on the developing sleeve even though the sheet having the low print image formed thereon is passed and that the image density is sufficiently high.

Figure 4:
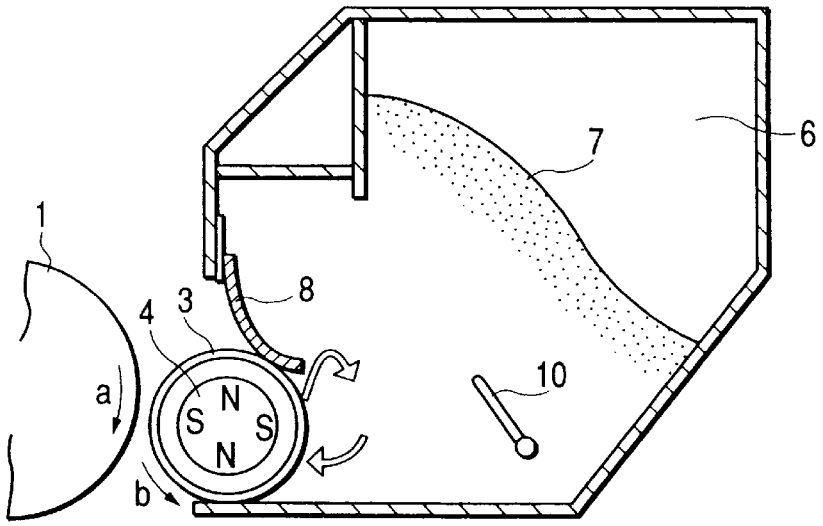
FIG. 4 is a cross-sectional view showing the developing apparatus in cases where the agitating means is stopped.

Furthermore, it has been discovered that when the agitation by the agitating member is stopped, the toner circulation in the toner container becomes large and that in the vicinity of the developing sleeve becomes very small as shown in FIG. 4.

On the other hand, when the agitating member rotates in connection with rotation of the developing sleeve, since rotation of the agitating member loosens the toner in the toner container, air is mixed in the toner to produce a gap, and circulation of the toner becomes large as shown in FIG. 10, which activates interchanging with the toner returning from the developing sleeve.

It can be considered that the fine powder is consequently collected on the developing sleeve.

(3) Intermittent Driving of Agitation

The particle size distribution of the toner on the developing sleeve and reduction in the image density after passing the solid white sheet were examined in cases where the agitating member was intermittently driven with respect to rotation of the developing sleeve.

Specifically, the control was effected so that the agitating member was driven to rotate for one page every time n pages were printed and the image density and A/B were measured after printing 20 sheets of the solid white original manuscript in which the image ratio is 0%. FIG. 6 shows its result.

Referring to FIG. 6, it has been found that the toner coat on the developing sleeve is stabilized and reduction in the image density can be suppressed if the time in which the agitating member is stopped is extended.

In this embodiment, the control is performed so that the agitating member is driven to rotate for one page every time seven pages are printed.

When the time for driving agitation is controlled so that the agitating member is driven to rotate for one page every time five or more pages are printed, reduction in density can be sufficiently minimized.

Although the appropriate values may differ depending on a shape of the toner container, an amount of toner, a printing speed and a rotational diameter of the agitating member, when the control for driving the agitating member is set so that the fine powder amount of the toner coat layer on the developing sleeve becomes appropriate, reduction in the density after printing the low print pattern can be sufficiently suppressed, thereby leading to stabilization.

As to control of agitation, besides the method for driving to cause a predetermined number of revolutions when a number of printed sheets reaches a given value as in this embodiment, agitation may be driven when a number of revolutions of the developer bearing member reaches a given value. Alternatively, two types of information, i.e., a number of printed sheets and a number of revolutions of the developer bearing member may be combined to drive the agitating member.

Further, when the control is effected so that the agitating member is driven to rotate for a predetermined number of times in accordance with image information such as when a number of dots to be developed (a number of print dots of a print image), e.g., an integrated value of the exposure time by exposing means (laser beam emitting time and the like) reaches a predetermined value, the appropriate control can be performed in accordance with a print ratio of a print image.

FIG. 7 shows the relationship between A/B and reduction in the image density $\Delta$ (the solid black density of the 0th solid white sheet—the solid black density after passing 20 solid white sheets shown in FIG. 5). It is determined that $\Delta$ of not more than 0.1 can suffice the image quality level.

As shown in FIG. 7, it is apparent that $\Delta$ is sufficiently small if $A/B \leqq 1.5$.

The above-mentioned experiment was conducted by using the toner having the original weight average particle diameter of 5.0 $\mu$m and a content of the fine powder, whose size is not more than 2.5 $\mu$m, of 16%. As in this embodiment, if the quantity ratio of the toner having the size of not more than 2.5 $\mu$m is within the range of $1{,}0 \leqq A/B \leqq 1.5$, reduction in the density after printing the low print pattern can be sufficiently suppressed Further, similar advantages were obtained in the intermittent driving of the agitating member.

As described above, assuming that the weight average particle diameter of the original toner is M; a quantity ratio of the particle diameter of not more than M/2 of the toner coated on the developing sleeve, A(%); and a quantity ratio of the particle diameter of not more than M/2 of the developer in the toner container, B (%), when the control is effected so that agitation is intermittently driven with respect to rotation of the developing sleeve, the toner layer is formed in the range of $1.0 \leqq A/B \leqq 1.5$. Consequently, it is possible to prevent the image density from being lowered after printing the low print pattern and obtain the constantly stable density even though the one-component magnetic developer having the weight average particle diameter of not more than 7 μm is used.

Second Embodiment

A second embodiment according to the present invention will now be described with reference to FIG. 8. It is to be noted that like reference numerals denote parts similar to those in the first embodiment to avoid the tautological explanation.

As shown in FIG. 8, this embodiment is characterized in that a member far from the developing sleeve is intermittently driven as similar to the first embodiment as well as that the agitating member which is closest to the developing sleeve is arranged below the toner container and its turning-radius is set to be small so that this drive is interlocked with the developing sleeve.

Since the agitating member closest to the developing sleeve is arranged below the toner container and its turning-radius is set to be small, it is not capable of supplying a large amount of new toner to the developing sleeve even if it rotates.

However, the toner in the vicinity of the developing sleeve can be mixed, which can further improve uniformity of the image density.

As described above, according to this embodiment, the image density after printing the low print pattern can be prevented from being lowered to obtain the constantly stable density even though the one-component magnetic developer having the weight average particle diameter of not more than 7 μm is used. Further, the uniformity in density can be improved.

Third Embodiment

A third embodiment according to the present invention will now be described with reference to FIG. 9. It is to be noted that like reference numerals denote structures similar to those in the first embodiment, thereby omitting the explanation thereof.

A characteristic of this embodiment lies in that the developing apparatus described in connection with the first embodiment is provided in an integral cartridge which can be replaced together with the photosensitive drum, the cleaner and the charging apparatus.

FIG. 9 shows an example of this integral cartridge.

In this embodiment, the developing apparatus, the photosensitive drum 1, the cleaning apparatus and the charging apparatus 2 are integrated by using an exterior package to be determined as the integral cartridge.

The above-described integral cartridge is designed so that life durations of its constituent parts are substantially simultaneously expired when the toner 7 is used up.

Therefore, the constantly stable image can be obtained while the toner exists in the integral cartridge, and the developing apparatus 6, the photosensitive drum 1, the cleaner and the charging apparatus 2 are integrated, which leads to such an advantage as that a user can readily replace the cartridge.

When the agitating member 10 according to the present invention is used in the developing apparatus 6 within the integral cartridge, such an advantage as that the stable density can be obtained from the initial stage can be added to the original merit of the integral cartridge.

As described above, according to this embodiment, by appropriately forming the particle size distribution of the developer layer formed on the developer bearing member, the image density obtained after printing the low print pattern can be prevented from being lowered even if the one-component magnetic developer having the weight average particle diameter of not more than 7 μm is used, and the developing apparatus or the image forming apparatus capable of achieving the constantly stable density can be provided.

What is claimed is:

1. A developing apparatus comprising:

a developer containing portion containing a developer having a weight average particle diameter of not more than 7 μm;

a developer bearing member for bearing a developer; and an agitating member that agitates developer contained in said developer containing portion, wherein said agitating member moves intermittently, every time a number of printed sheets reaches a predetermined number of sheets.

2. A developing apparatus according to claim 1, wherein the developer is a one-component magnetic developer.

3. A developing apparatus according to claim 1, wherein said agitating member intermittently rotates.

4. A developing apparatus according to claim 1, wherein said agitating member rotates independently from said developer bearing member.

5. A developing apparatus according to claim 1, wherein said agitating means moves every time a number of dots to be developed reaches a predetermined number.

6. A developing apparatus according to claim 1, wherein another agitating member is provided at a position closer to said developer bearing member than said agitating member, and said another agitating member cooperates with said developer bearing member.

7. A developing apparatus according to claim 6, wherein a radius of agitation of said another agitating member is smaller than a radius of agitation of said agitating member.

8. A developing apparatus according to claim 1, wherein said developing apparatus is made into a unit with an image bearing member and detachably attachable to a main body of an image forming apparatus.

9. A developing apparatus comprising:

a developer containing portion containing a developer having a weight average particle diameter of not more than 7 μm;

a developer bearing member for bearing a developer; and an agitating member that agitates developer contained in said developer containing portion, wherein said agitating member moves intermittently, every time a number of rotations of said developer bearing member reaches a predetermined number of rotations.

10. A developing apparatus according to claim 9, wherein said agitating member moves every time a number of printed sheets reaches a predetermined number of sheets.

11. An image forming apparatus comprising:

an image bearing member for bearing a latent image; and a developing apparatus for developing the latent image, said developing apparatus including:

a developer containing portion containing a developer having a weight average particle diameter of not more than 7 μm;

a developer bearing member for bearing a developer; and an agitating member that agitates developer contained in said developer containing portion, wherein said agitating member moves intermittently, every time a number of printed sheets reaches a predetermined number of sheets.

12. An image forming apparatus according to claim 11, wherein the developer is a one-component magnetic developer.

13. An image forming apparatus according to claim 11, wherein said agitating member intermittently rotates.

14. An image forming apparatus according to claim 11, wherein said agitating member rotates independently from said developer bearing member.

15. An image forming apparatus according to claim 11, wherein said agitating means moves every time a number of dots to be developed reaches a predetermined number.

16. An image forming apparatus according to claim 11, wherein another agitating member is provided at a position closer to said developer bearing member than said agitating member, and said another agitating member cooperates with said developer bearing member.

17. An image forming apparatus according to claim 16, wherein a radius of agitation of s aid another agitating member is smaller than a radius of agitation of said agitating member.

18. An image forming apparatus comprising:

an image bearing member for bearing a latent image; and a developing apparatus for developing the latent image, said developing apparatus including:

a developer containing portion containing a developer having a weight average particle diameter of not more than 7 $\mu$m;

a developer bearing member for bearing a developer; and an agitating member that agitates developer contained in said developer containing portion, wherein said agitating member moves intermittently, every time a number of rotations of said developer bearing member reaches a predetermined number of rotations.

19. An image forming apparatus according to claim 18, wherein said agitating member moves every time a number of printed sheets reaches a predetermined number of sheets.

20. A developing apparatus comprising:

a developer containing portion containing a developer;

a developer bearing member for bearing the developer, said developer bearing member developing an electrostatic image formed on an image bearing member with the developer; and an agitating member that agitates developer contained in said developer containing portion, wherein said agitating member moves intermittently, and wherein a timing at which said agitating member intermittently moves is determined by at least one of a number of sheets on which an image is formed and a rotation number of said developer bearing member.

21. A developing apparatus according to claim 20, wherein the developer is a one-component magnet developer.

22. A developing apparatus according to claim 20, wherein said agitating member intermittently rotates.

23. A developing apparatus according to claim 20, wherein said agitating member rotates independently from said developer bearing member.

24. A developing apparatus according to claim 20, wherein said agitating member moves every time the number of sheets on which an image is formed reaches a predetermined number.

25. A developing apparatus according to claim 20, wherein said agitating member moves every time the rotation number of said developer bearing member reaches a predetermined number.

26. A developing apparatus according to claim 20, wherein another agitating member is provided at a position closer to said developer bearing member than said agitating member, and said another agitating member cooperates with said developer bearing member.

27. A developing apparatus according to claim 26, wherein a radius of agitation of said another agitating member is smaller than a radius of agitation of said agitating member.

28. A developing apparatus according to claim 20, wherein said developer apparatus is provided with a process cartridge detachably attachable to a main body of an image forming apparatus with said image bearing member.

29. A developing apparatus according to any one of claims 20 to 28, wherein the developer has a weight average particle diameter of not more than 7 $\mu$m.

30. A developing apparatus comprising:

a developer containing portion containing a developer;

a developer bearing member for bearing the developer, said developer bearing member developing an electrostatic image formed on an image bearing member with the developer; and an agitating member that agitates developer contained in said developer containing portion, wherein said agitating member moves intermittently, and wherein a timing at which said agitating member moves is determined in accordance with an image information of the electrostatic image.

31. A developing apparatus according to claim 30, wherein the developer is a one-component magnetic developer.

32. A developing apparatus according to claim 30, wherein said agitating member intermittently rotates.

33. A developing apparatus according to claim 30, wherein said agitating member rotates independently from said developer bearing member.

34. A developing apparatus according to claim 30, wherein the image information of the electrostatic image is a number of image dots of the electrostatic image.

35. A developing apparatus according to claim 30, wherein said agitating member moves every time an integrated value of the number of the image dots reaches a predetermined number.

36. A developing apparatus according to claim 30, wherein another agitating member is provided at a position closer to said developer bearing member than said agitating member, and said another agitating member cooperates with said developer bearing member.

37. A developing apparatus according to claim 36, wherein a radius of agitation of said another agitating member is smaller than a radius of agitation of said agitating member.

38. A developing apparatus according to claim 30, wherein said developing apparatus is provided with a process cartridge detachable attachable to a main body of an image forming apparatus with said image bearing member.

39. A developing apparatus according to any one of claims 30 to 38, wherein the developer has a weight average particle diameter of not more than 7 $\mu$m.

* * * * *

UNITED STATES PATENT AND TRADEMARK OFFICE

CERTIFICATE OF CORRECTION

PATENT NO. : 6,370,348 B1
DATED : April 9, 2002
INVENTOR(S) : Keiji Okano et al.

It is certified that error appears in the above-identified patent and that said Letters Patent is hereby corrected as shown below:

Column 11,
Line 23, “s aid” should read -- said --.

Signed and Sealed this

Eleventh Day of June, 2002

*Attest:*

*Attesting Officer*

JAMES E. ROGAN
*Director of the United States Patent and Trademark Office*